US008029302B1

(12) United States Patent
Duan

(10) Patent No.: US 8,029,302 B1
(45) Date of Patent: Oct. 4, 2011

(54) STRAP WITH CHARGING AND DATA TRANSMITTING FUNCTION

(76) Inventor: Xingyi Duan, Dongguan (CN)

( * ) Notice: Subject to any disclaimer, the term of this patent is extended or adjusted under 35 U.S.C. 154(b) by 0 days.

(21) Appl. No.: 12/802,892

(22) Filed: Jun. 17, 2010

(51) Int. Cl.
*H01R 13/44* (2006.01)

(52) U.S. Cl. ..... 439/142; 439/638

(58) Field of Classification Search ..... 439/142, 439/131, 136, 638
See application file for complete search history.

(56) References Cited

U.S. PATENT DOCUMENTS 6,549,791 B1 * 4/2003 Jeon et al. ..... 455/572
7,503,780 B1 * 3/2009 Huang ..... 439/135
7,614,176 B2 * 11/2009 Wabnitz ..... 43/3
2007/0064542 A1 * 3/2007 Fukushima ..... 368/282
2007/0141915 A1 * 6/2007 Kim ..... 439/640
2010/0267276 A1 * 10/2010 Wu et al. ..... 439/502

* cited by examiner

*Primary Examiner* — Tulsidas Patel
*Assistant Examiner* — Travis Chambers
(74) *Attorney, Agent, or Firm* — Charles E. Baxley

(57) ABSTRACT

An ornamental strap with charging and data transmitting function is disclosed, The ornamental strap comprises: a data cable; a base; a data connector rotatably connected to the base; and a USB connector; wherein a positioning groove is provided between the data connector and the base; the data cable has one end connected to the data connector, and the other end bent and turned back to connect with the USB connector after passing through the positioning groove. Therefore, the data cable forms a loop at one end of the base such that it can be carried about and will not be lost easily, and further it can be used as an ornament.

5 Claims, 5 Drawing Sheets

STRAP WITH CHARGING AND DATA TRANSMITTING FUNCTION

FIELD OF THE INVENTION

The present invention relates to a device with charging and data transmitting function, and in particular to an ornamental strap with charging and data transmitting function.

BACKGROUND OF THE INVENTION

Digital mobile equipment such as cell phone, MP3/MP4, digital camera and digital video recorder, is normally supplied by a built-in rechargeable battery pack. When recharging is required, a charger is usually used for charging the mobile equipment such that the mobile equipment may be used again. Furthermore, a data cable is used for the data transmission between the digital mobile equipment and the host computer. The charger in the prior art normally has a long wire, and the data cable is also relatively long, so that it is inconvenient for use and carrying about, and it may be lost easily due to not carrying the cable about. Moreover, the wire of the charger or the data cable is always simple without any ornament, while the ornamental strap is only used for decoration without the function of charging and data transmitting.

SUMMARY OF THE INVENTION

Having the state of the prior art and its attendant shortages, it is an object of the present invention to provide an ornamental strap with charging and data transmitting function which is convenient to carry about and ornamental for use.

The above object is achieved by the following technical solutions:

An ornamental strap with charging and data transmitting function comprises: a data cable; a base; a data connector rotatably connected to the base; and a USB connector; wherein a positioning groove is provided between the data connector and the base; the data cable has one end connected to the data connector, and the other end bent and turned back to connect with the USB connector after passing through the positioning groove.

Preferably, the base is provided with a base plate, the positioning groove is provided on the inner side of the base plate.

Alternatively, the positioning groove is provided on the side of the data connector close to the base and extends through the data connector.

Preferably, the base is provided with a base plate, two side plates extend along both sides of the base plate, each of the side plates is provided with a first pivot hole; the data connector comprises a rotatable bracket, a cover on the rotatable bracket and an insert portion between the rotatable bracket and the cover, first pivoting portions for connecting with the first pivoting holes are respectively projected from both sides of the rotatable bracket.

Preferably, the insert portion has a first base portion for clamping between the rotatable bracket and the cover, and a first tongue plate is extended from one end of the first base portion and protruded out of the rotatable bracket.

Preferably, a cover is rotatably connected to the base, the data connector is provided with a first tongue plate protruded and received in the base, the cover has a protection plate for covering over the first tongue plate.

Preferably, the base is provided with a base plate, two side plates extend along both sides of the base plate, each of the side plates is provided with a second pivot hole; two connection ears extending downwards are respectively formed on both sides of the protection plate, and two second pivoting portions for connecting with the second pivot holes are respectively protruded from the connection ears.

Preferably, the USB connector is sleeved with a protection sleeve, the USB connector is provided with a second base portion, the second base portion has a second tongue plate and an elastic arm extending in a plane different from that of the second tongue plate, the elastic arm has a free end on which a buckle portion is formed; the protection sleeve is a hollow casing with an opening facing the USB connector, the protection casing is provided with a holding hole for buckling with the buckle portion when the second tongue plate is sleeved within the protection sleeve.

In the present invention, a positioning groove is provided between the data connector and the base; the data cable has one end connected to the data connector, and the other end bent and turned back to connect with the USB connector after passing through the positioning groove. Therefore, the data cable forms a loop at one end of the base such that it can be carried about and will not be lost easily, and further it can be used as an ornament.

DETAILED DESCRIPTION OF THE PREFERRED EMBODIMENT

Many aspects of the invention can be better understood in the following embodiments with reference to the accompanying drawings.

Figure 1:
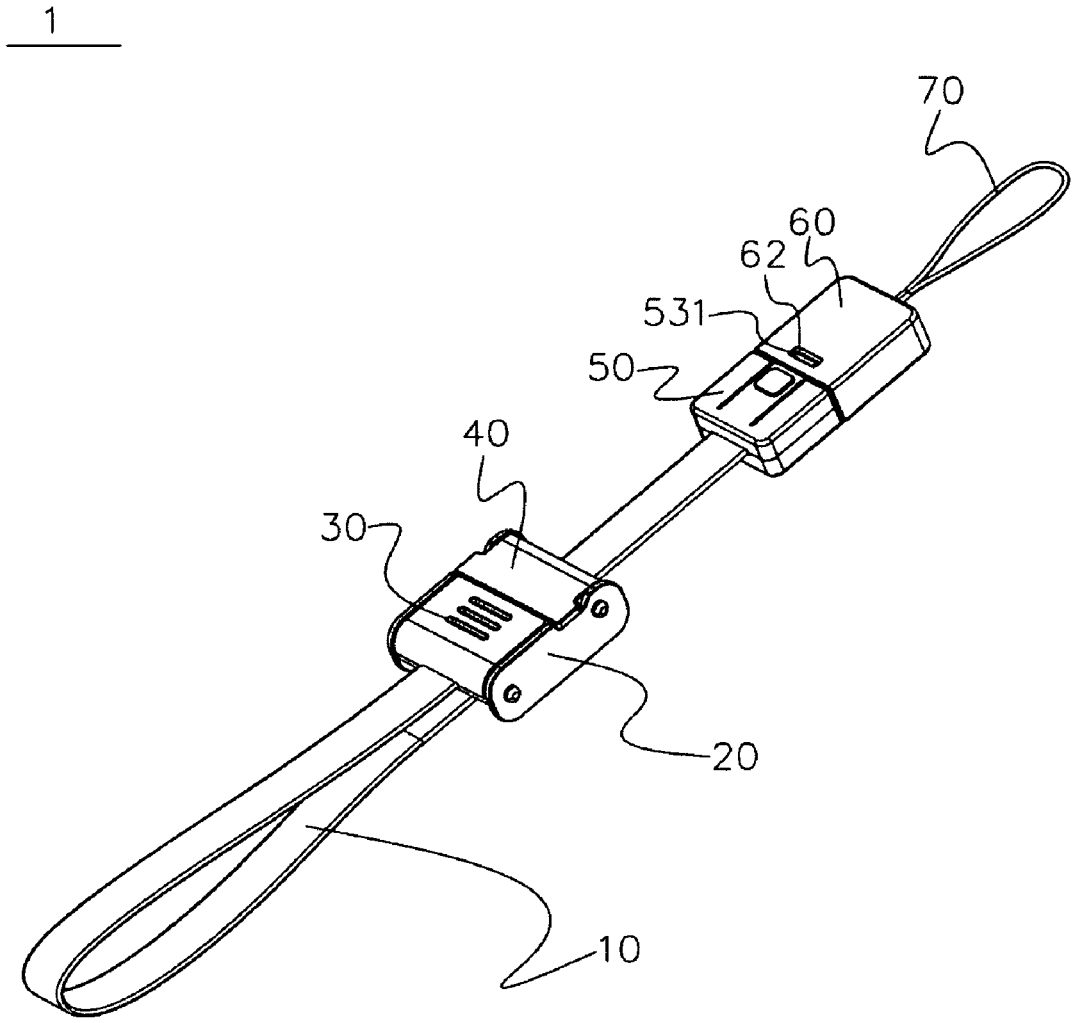
FIG. 1 is a perspective view of an embodiment of the present invention.

Referring to FIG. 1, the ornamental strap with charging and data transmitting function 1 includes a data cable 10 in flat strip shape, a base 20, a data connector 30 connected to one end of the data cable 10 and rotatably connected in the base 20, a protection cover 40 pivoted to the base 20, a USB connector 50 connected to the other end of the data cable, a protection sleeve 60 enveloping over one end of the USB connector 50, and a sling 70 connected to the USB connector 50.

Figure 3:
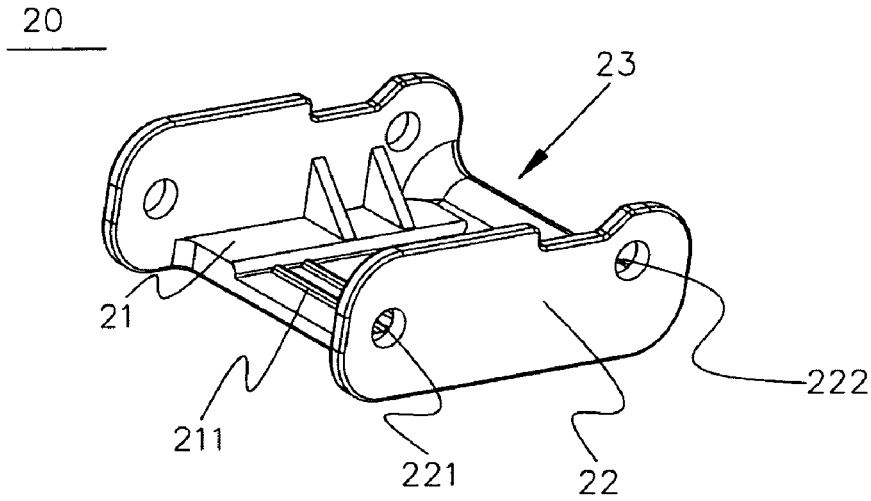
FIG. 3 is a perspective view of the base shown in FIG. 1.

Referring to FIGS. 1 and 3, the base 20 has a base plate 21 substantially in rectangular shape, and two opposite side plates 22 are provided on the base plate 21. A space 23 is defined by the base plate 21 and the two opposite side plates 22. A positioning groove 211 is formed substantially in rectangular shape, extending lengthways through the base plate. Both ends of each of the side plates 22 are respectively provided with a first pivot hole 221 and a second pivot hole 222 that is slightly higher than the first pivot hole 221.

Figure 2:
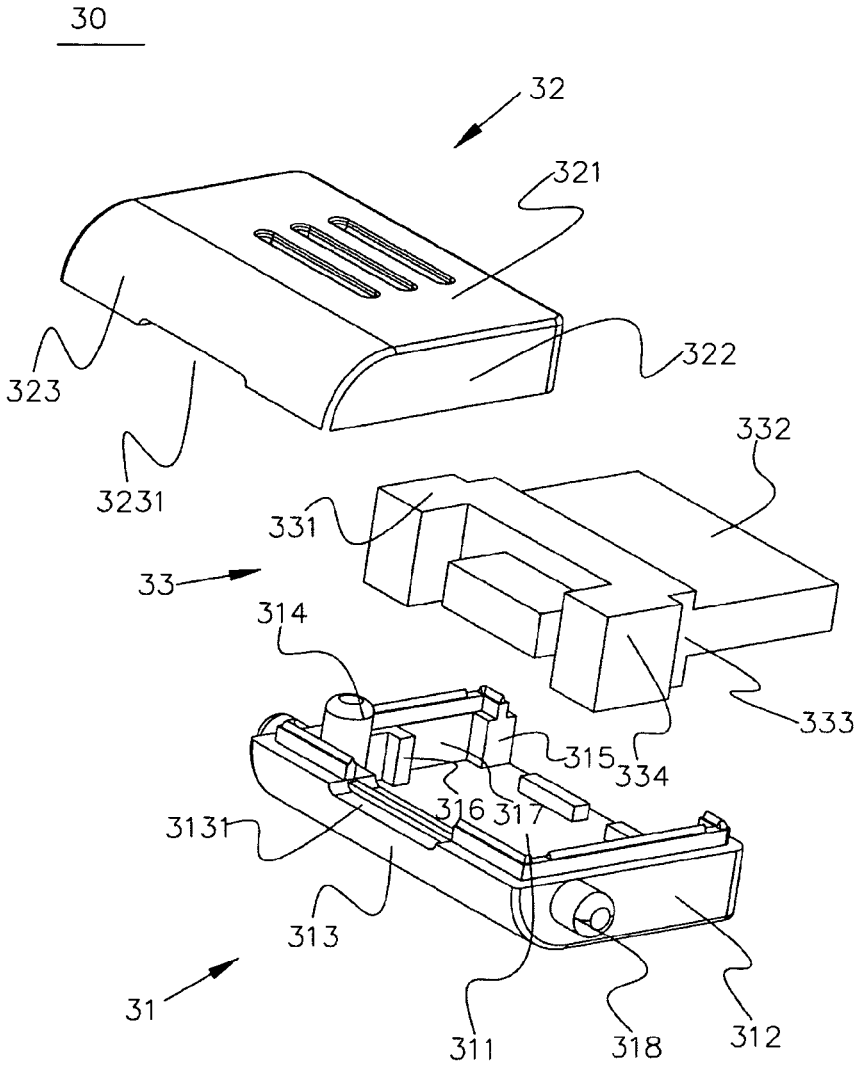
FIG. 2 is an exploded view of the data connector shown in FIG. 1.
Figure 5:
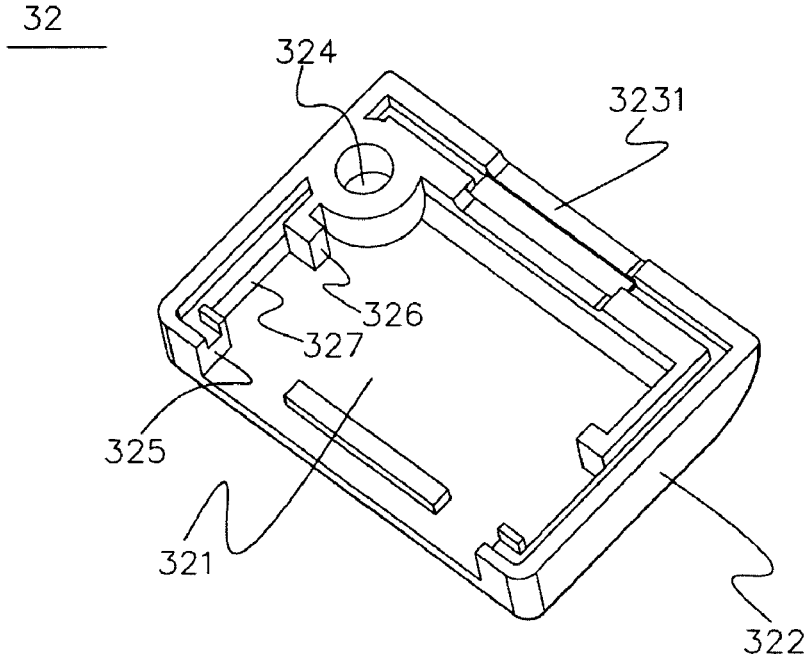
FIG. 5 is a perspective view of the top cover shown in FIG. 1.

As shown in FIGS. 1, 2 and 5, the data connector 30 is received in one end of the space 23 of the base 20, and includes a rotatable bracket 31 rotatably connected to one end of the base 20, a cover 32 covering over the rotatable bracket 31 and an insert portion 33 between the cover 32 and the rotatable bracket 31. The rotatable bracket 31 has a bottom plate 311 in substantially rectangular shape. First sidewalls 312 are respectively and oppositely provided on both sides of the bottom plate 311. The bottom plate 311 has a first front plate 313 on its front end, and the first front plate extends upwards in arch manner and connected between the opposite first sidewalls 312. The top of the first front plate 313 has a recess in substantially rectangular shape. A protruded cylindrical retaining portion 314 is formed on the left front corner of the rotatable bracket 31. A first clamping block 315 is protruded inwards on the inner wall of the first sidewall 312, and a first limit block 316 is formed in front of the first clamping block 315, so that a first receiving space 317 in substantially rectangular shape is defined between the first clamping block 315 and the first limit block 316. The first sidewall 312 is outwards provided with a first pivoting portion 318 corresponding to the first pivot hole 221. The cover 32 has a top plate 321 in substantially rectangular shape and opposite to the bottom plate 311. The top plate 321 has two second sidewalls 322 opposite to each other and corresponding to the first sidewalls 312 respectively. The top plate 321 has a second front plate 323 extending downwards in arch manner corresponding to the first front plate 313 and connected between the opposite second sidewalls 322. The bottom end of the second front plate 323 has a second recess 3231 in rectangular shape and corresponding to the first recess 3131. The top cover 32 is provided with a retaining groove 324 on a corner corresponding to the retaining portion 314 on the rotatable bracket 31. A second clamping block 325 and a second limit clock 326 in front of the second clamping block 325 are protruded from the inner side of the second sidewall 322 such that a second receiving space 327 in substantially rectangular shape is defined between the second clamping block 325 and the second limit clock 326. The insert portion 33 has a first base portion 331 in substantially rectangular shape, and a first tongue plate 332 is protruded backwards on the middle of the first base portion 331. The first base portion 331 is provided at the front end on both sides with two clamping recesses 333 opposite to each other, and two retaining portions 334 are formed at the rear end on both sides of the first base portion 331.

Figure 4:
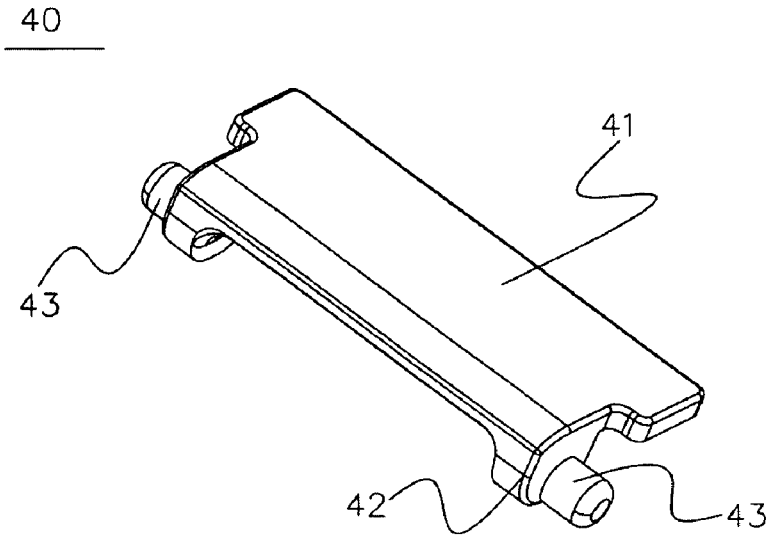
FIG. 4 is a perspective view of the protection cover shown in FIG. 1.

As shown in FIG. 1 and FIG. 4, the protection cover 40 has a protection plate 41 in substantially rectangular shape. The protection plate 41 is provided at the rear end on both sides with two connection ears 42 in arch shape and extending downwards. A second pivoting portion 43 is protruded outwards from the connection ear 42 corresponding to the second pivot hole 222.

Referring to FIGS. 1 to 5, during the assembling, the top cover 32 is covered over the rotatable bracket 31 and the front end of the insert portion 33 is disposed between the rotatable bracket 31 and the top cover 32. The lower end of the retaining portion 334 is received in the first receiving space 317 and its two ends leaning against the first clamping block 315 and the first limit block 316 respectively. The upper end of the retaining portion 334 is received in the second receiving space 327 and its two ends leaning against the second clamping block 325 and the second limit block 326 respectively. The first clamping block 315 and the second clamping block 325 are further received in the corresponding clamping recess 333. The retaining portion 314 is held in the retaining groove 324 such that the top cover 32 is retained on the rotatable bracket 31 stably. The first recess 3131 of the rotatable bracket 31 and the second recess 3231 of the top cover 32 form a connection opening (not shown). The data connector 30 is pivoted to the front end of the base 20. The first pivoting portion 318 of the rotatable bracket 31 is cooperated with the pivot hole 221 of the base 20. The bottom plate 311 is located above the positioning groove 211 of the base plate 21. The protection cover 40 is pivoted to the rear end of the base 20. The second pivoting portion 43 is received in the second pivot hole 222. The connection ears 42 are respectively located on the inner sides of the two sidewalls 22. The front edge of the protection plate 41 leans against the rear edge of the top plate 321 of the top cover 32, and the protection plate 41 further covers over the first tongue plate 332 to prevent the latter from the damage from outside.

Figure 6:
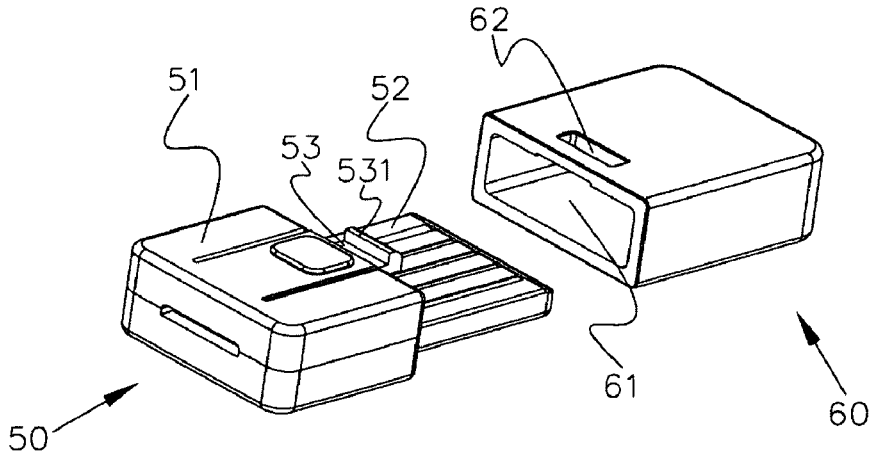
FIG. 6 is a perspective view showing the USB connector and the protection sleeve shown in FIG. 1 before assembly.
Figure 7:
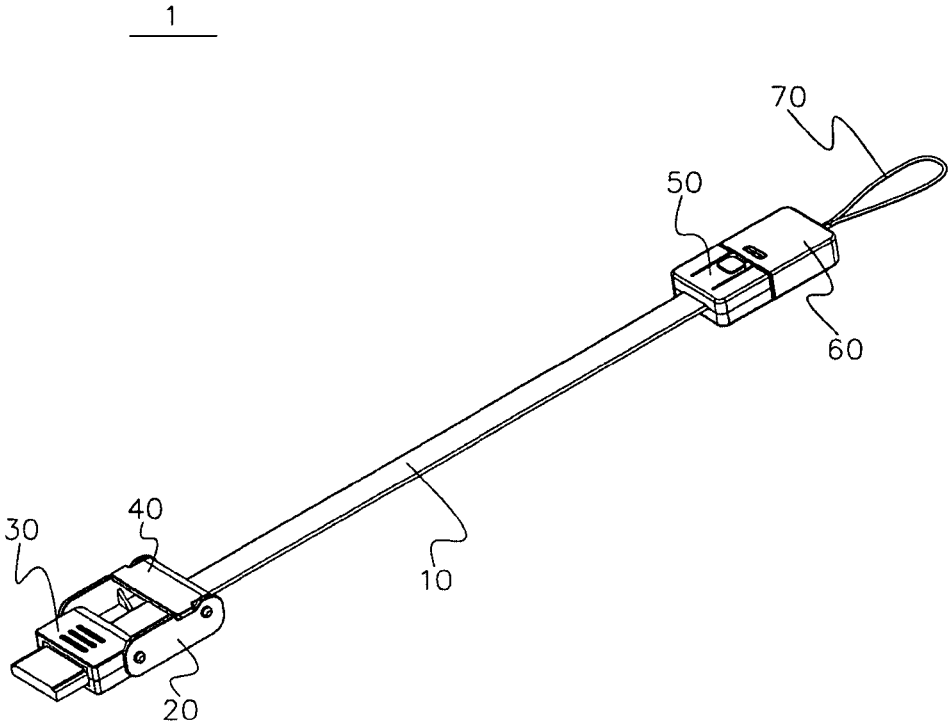
FIG. 7 is a perspective view showing the ornamental strap in use.

Referring to FIG. 1 and FIG. 6, the USB connector 50 has a second base portion 51 in substantially rectangular shape, and a second tongue plate 52 in flat shape is extended rearwards from the middle of the second base portion 51 and located above the elastic arm 53. The front end of the elastic arm 53 has a buckle portion 531 which is protruded slightly higher than the upper surface of the second base portion 51. The protection sleeve 60 is a hollow casing with an opening, and thus a receiving space 61 with the opening in the sleeve 60. The top wall of the protection sleeve 60 is provided with a holding hole 62 in substantially rectangular shape on the front end for cooperating with the buckle portion 531. The sling 70 is connected to the rear end of the protection sleeve 60 such that it will not be lost easily and can be used as an ornament. During the assembling, the second tongue plate 52 is inserted into the receiving space 61, and the buckle portion 531 leans against the front edge of the top wall of the protection sleeve 60. The second tongue plate 52 is further pushed into the receiving space 61, and the elastic wall 53 will move downwards and lean against the top wall of the protection sleeve 60 while the buckle portion 531 is buckled in the holding hole 62. Meanwhile, the second tongue plate 52 is entirely received in the space 61 to avoid the damage from outside.

Referring to FIG. 1 to FIG. 6, in the non-use state, one end of the data cable 10 is connected to the rear end of the insert portion 33 through the connection port of the data connector 30. The other end of the data cable 10 is bent downwards and turned back to enter into one end of the base 20 and then pass through the positioning groove 211 to extend out from the other end of the base 20, and finally connected to the front end of the USB connector 50. Therefore, the data cable 10 forms a loop at one end of the base 20 such that it can be carried about and will not be lost easily, and further it can be used as an ornament. In addition, the data cable 10 is designed to further contain ornamental patterns or the like for better decoration.

As shown in FIGS. 2 to 7, in the use state, the base 20 is moved forwards along the positioning groove 211 on the data cable 10, the length of the data cable 10 between the USB connector 50 and the base 20 increases gradually, while the length of the data cable 10 at the other end of the base 20 decreases gradually until the length of the data cable 10 between the connection port and the end of the positioning groove is minimal, then the data cable 10 is in substantially straight state, and then the protection cover 40 is rotated in clockwise to uncover the first tongue plate 332. The rotatable bracket 31 is then rotated anticlockwise such that the data connector 30 is rotated in anticlockwise direction to a desired state for the use of the user.

In conclusion, in the ornamental strap with charging and data transmitting function 1, by providing the positioning groove 211 between the base 20 and the data connector 30, one end of the data cable 10 is connected to the data connector 30, and the other end of the data cable is bent and turned back to pass through the positioning groove 211 and finally connect to the USB connector 50. Thus, the data cable 10 forms a loop at one end of the base 20 such that it is convenient for carrying by the user and is of decoration function.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims. For example, the USB connector 50 may be a data connector of other types. The bottom plate 311 of the data connector 30 may be also provided, on the side close to the base 20, with a positioning groove 211 that extends through two opposite ends of the bottom plate 311.

What is claimed is:

1. An ornamental strap with charging and data transmitting function, comprising:

a data cable (10);

a base (20);

a data connector (30) rotatably connected to the base (20); and a USB connector (50);

wherein a positioning groove (211) is provided between the data connector (30) and the base (20); the data cable (10) has one end connected to the data connector (30), and the other end bent and turned back to connect with the USB connector (50) after passing through the positioning groove (211) wherein the positioning groove (211) is provided on the side of the data connector (30) close to the base (20), and extends through the data connector (30).

2. The ornamental strap of claim 1 wherein the base (20) is provided with a base plate (21), two side plates (22) extend along both sides of the base plate (21), each of the side plates (22) is provided with a first pivot hole (221); the data connector (30) comprises a rotatable bracket (31), a cover (32) on the rotatable bracket (31) and an insert portion (33) between the rotatable bracket (31) and the cover (32), first pivoting portions (318) for connecting with the first pivoting holes (221) are respectively projected from both sides of the rotatable bracket (31).

3. The ornamental strap of claim 2, wherein the insert portion (33) has a first base portion (331) for clamping between the rotatable bracket (31) and the cover (32), and a first tongue plate (332) is extended from one end of the first base portion (331) and protruded out of the rotatable bracket (31).

4. The ornamental strap of claim 1 wherein the base (20) is provided with a rotatable cover (40), the data connector (30) is provided with a first tongue plate (332) protruded and received in the base (20), the rotatable cover (40) has a protection plate (41) for covering over the first tongue plate (332).

5. The ornamental strap of claim 4, wherein the base (20) is provided with a base plate (21), two side plates (22) extend along both sides of the base plate (21), each of the side plates (22) is provided with a second pivot hole (222); two connection ears (42) extending downwards are respectively formed on both sides of the protection plate (41), and two second pivoting portions (43) for connecting with the second pivot holes are respectively protruded from the connection ears (42).

* * * * *